US005865344A

United States Patent [19]

Nagel

[11] Patent Number: 5,865,344

[45] Date of Patent: Feb. 2, 1999

[54] WATER GUN WITH REFILLABLE PRESSURIZED BLADDER CHAMBER

[76] Inventor: Dietmar Nagel, 11 S. Rd., Chester, N.J. 07930-2739

[21] Appl. No.: 923,153

[22] Filed: Sep. 4, 1997

[51] Int. Cl.[6] ..... A63H 3/18

[52] U.S. Cl. ..... 222/79; 222/212; 92/90; 417/474

[58] Field of Search ..... 222/79, 212, 95, 222/386.5, 252, 256; 92/90; 417/474

[56] References Cited

U.S. PATENT DOCUMENTS 4,854,480 8/1989 Shindo ..... 222/79
5,366,108 11/1994 Darling ..... 222/79 X
5,758,800 6/1998 D'Andrade ..... 222/79

*Primary Examiner*—Gregory L. Huson
*Attorney, Agent, or Firm*—Cohen, Pontani, Lieberman & Pavane

[57] ABSTRACT

A toy water pistol for discharging a volume of liquid temporarily stored under pressure in an expandable bladder. The water pistol includes a reservoir containing liquid which is initially supplied from the reservoir to a charge cavity upon manipulation of a piston. The liquid in the charge cavity is then provided to the bladder, in a pressurized state, through further manipulation of the piston. A trigger is provided for selectively controlling the flow of liquid in an output conduit, which is connected to the bladder, to regulate the liquid expelled from the bladder and output from the water pistol upon user activation of the trigger.

14 Claims, 5 Drawing Sheets

WATER GUN WITH REFILLABLE PRESSURIZED BLADDER CHAMBER

BACKGROUND OF THE INVENTION

I. Field of the Invention

This invention relates to toy guns and in particular to toy water pistols. More particularly, the present invention relates to a toy water pistol having a refillable chamber wherein a supply of pressurized liquid is maintained prior to discharge.

II. Background Art

Water pistols have existed for many years. Typically such water pistols consist of a barrel, a reservoir in which water is kept, and a trigger. The trigger is connected to a plunger-type mechanism which interacts with water contained in the reservoir such that when the trigger is moved by a particular amount, the plunger forces an amount of water into the barrel for immediate discharge.

A drawback associated with such prior art water guns is that the amount of water discharged for each movement of the trigger is limited to the amount of motion imparted to the trigger. In other words, the amount of liquid discharged from the pistol is proportional to the trigger movement.

Other types of water guns operate on air pressure wherein a water chamber is pressurized by operating a plunger to increase the air pressure in the chamber. When the trigger on the gun is depressed and as long as it remains depressed, liquid in the chamber is expelled through the gun barrel until the air pressure in the chamber reaches an ambient condition. To re-fire the gun, the chamber is re-pressurized by again operating the piston.

Accordingly, it is an object of the present invention to provide a water gun wherein a predetermined amount of liquid is injected into a flexible chamber which maintains the injected liquid under pressure so that when a trigger is activated, the chamber pressure expels the liquid from the gun. It is a further object of the present invention to provide a toy gun wherein a bladder is reloadable with liquid contained in a reservoir and wherein when liquid is loaded into the bladder, the liquid is maintained under pressure until discharged by activation of a trigger mechanism.

SUMMARY OF THE INVENTION

The present invention relates to a toy water gun or water pistol wherein a bladder is used to hold a predetermined amount of liquid under pressure until a trigger mechanism is activated. Upon activation of the trigger mechanism, the pressurized liquid in the bladder is discharged until either the trigger mechanism is released or until substantially all of the liquid contained in the bladder is discharged.

In accordance with the present invention, the inventive toy gun contains an inflatable bladder chamber which receives liquid from an inlet tube. Liquid is supplied to the inlet tube from a reservoir by manipulating a charging mechanism. In particular, when a piston is at least partially withdrawn from a piston sleeve, liquid from the reservoir is drawn into a loading cavity. Upon reinsertion of the piston into the piston sleeve, the liquid in the loading cavity is forced into the bladder, thereby causing the bladder to inflate or expand which, in turn, applies pressure to the liquid contained therein. An outlet of the bladder communicates with an outlet tube for discharging liquid in the bladder through a gun barrel. The discharge of bladder liquid is controlled by a trigger mechanism which creates a pinch point in the outlet conduit.

In the preferred embodiment, upon discharge of the bladder liquid, additional liquid contained in the reservoir can be re-supplied to the bladder by manipulating the charging mechanism.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
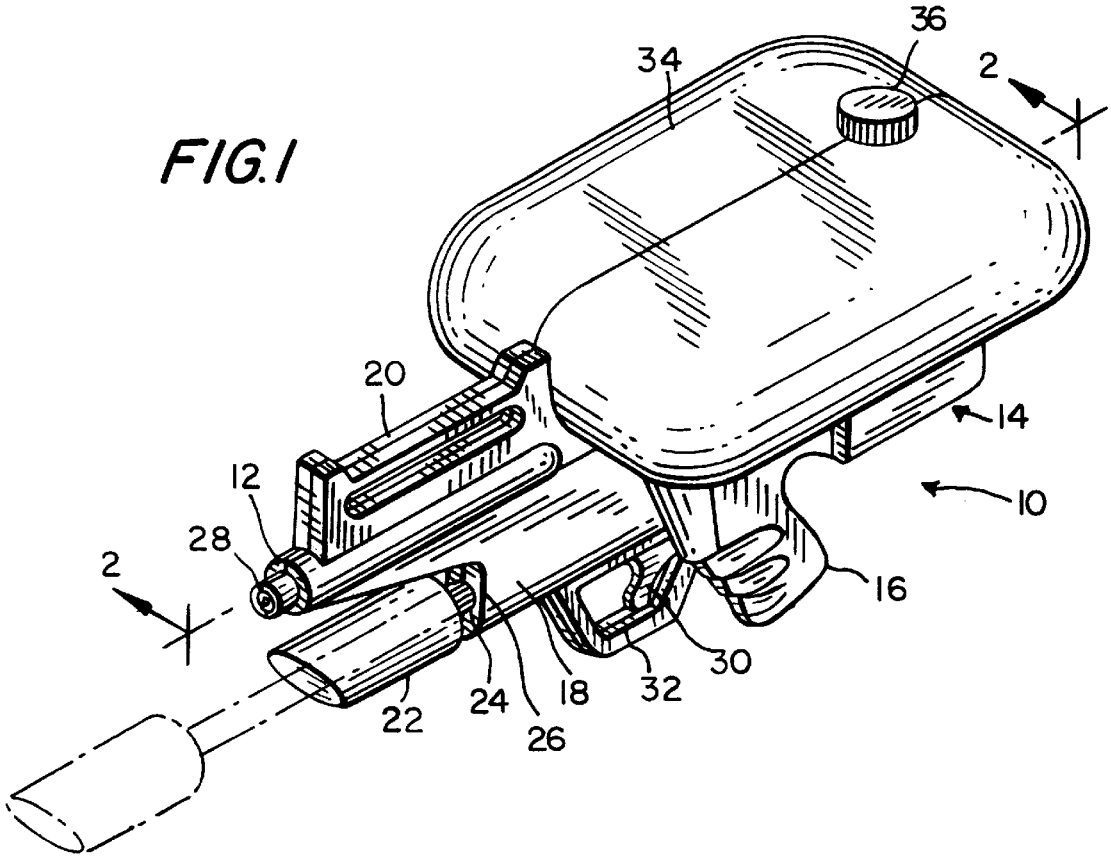
FIG. 1 is a top-perspective view of a water gun constructed in accordance with the present invention.

Referring now to the drawings and initially to FIG. 1, a perspective view of a water gun 10 constructed in accordance with the present invention is there-depicted. As shown, the water gun includes a barrel 12 mounted to a support 14 having a handle portion 16 and an elongated member portion 18. A gun sight 20 is positioned on the barrel to assist a user in aiming the water gun 10. A charge mechanism 21 including a piston rod 22 is positioned at the end of a piston 24 which is slideably movable within a piston sleeve 40 formed in the elongated member portion 18. As will be explained more fully below, charge mechanism 21 is used for loading liquid into a pressurized chamber.

Figure 3:
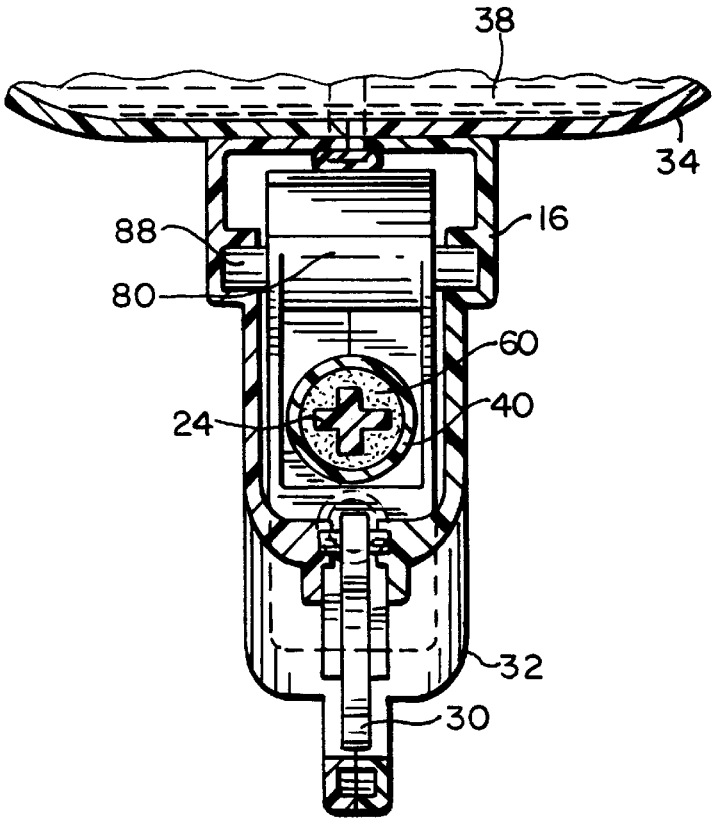
FIG. 3 is a partial cross-sectional view of the water gun of FIG. 1 taken along the lines 3—3 in FIG. 2.
Figure 2:
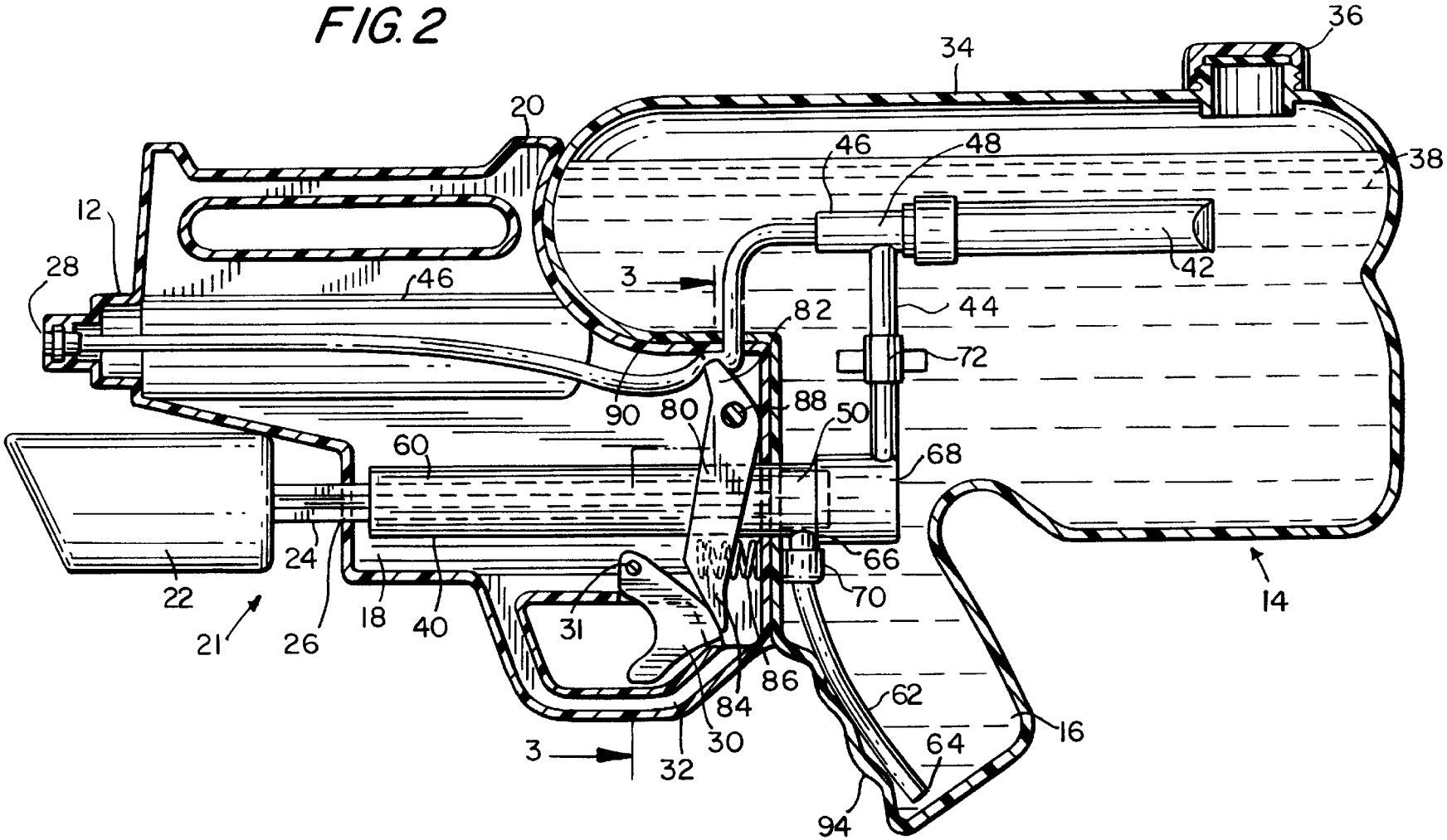
FIG. 2 is a cross-sectional view of the water gun of FIG. 1 taken along the lines 2—2 in FIG. 1.

With reference now to FIGS. 1–3, water gun 10 includes a discharge end 28 positioned at the end of barrel 12 through which discharged liquid is expelled when the water gun is activated. Water gun 10 includes a trigger 30 which, in the preferred embodiment, is pivotally connected by a trigger fastener 31 to the elongated member portion 18 of support 14. Trigger 30 is protected by a trigger guard 32 to prevent accidental firing of the water gun 10. As shown in FIG. 2, support 14 includes a reservoir or tank 34 in which liquid, such as water 38, is contained. Additional liquid 38 can be provided to tank 34 via a removable filling cap 36 which, in the preferred embodiment, is rotatably screwed or otherwise engageable with a filling inlet on tank 34. A flexible magazine chamber or bladder 42 is contained within the reservoir tank 34 and, as explained more fully below, is inflated with a maximally predetermined amount of liquid from tank 34 upon activation of piston rod 22. Bladder 42 has an opened end affixed to a bladder support 48 which communicates bladder 42 with a bladder inlet 44 and a bladder outlet 46. Bladder inlet 44 provides liquid from reservoir 34 to bladder 42, and outlet 46 carries liquid expelled from bladder 42 to the discharge end 28 for discharging the bladder liquid when the trigger 30 is activated.

With reference again to the charge mechanism 21 and as shown in FIGS. 2 and 3, charge mechanism 21 includes a piston sleeve 40 in which piston 24, which passes through an opening 26 formed in the elongated member portion 18 of support 14, is disposed. Preferably, piston 24 has a "+" cross-sectional shape (as shown in FIG. 3) which is disposed within sleeve 40 so that the piston is not in contact with the sleeve walls and for enhanced durability. One end of piston 24 is connected to piston rod 22 which serves as a handle for moving the piston in and out of sleeve 40. An inner end of piston 24 is connected to a plunger 50 dimensioned for slidable engagement within piston sleeve 40. When piston rod 22 is displaced outward away from support 14 such that piston 24 is unsheathed from or drawn out of piston sleeve 40, thereby moving plunger 50, a loading cavity 60 is formed in piston sleeve 40 in which an amount of liquid is displaced for filling bladder chamber 42, as more fully described below.

As shown in FIG. 2, a loading inlet or tube 62 is disposed in the handle portion 16 of support 14. Loading inlet 62 has an inlet end 64 and an outlet end 66, with the outlet end positioned in an opening formed in piston sleeve 40 for providing liquid from the reservoir tank 34 to the loading cavity 60. A collar member 68 is also connected to piston sleeve 40 and, in particular, to the inner end of the piston sleeve for providing liquid from the loading cavity 60 to the bladder inlet 44 for filling the bladder chamber 42. Collar 68 may be affixed to piston sleeve 40 in any suitable manner known to those having ordinary skill in the art, such, for example, as by friction fit, glue, etc.

As will also be more fully described below, loading inlet 62 has a loading inlet valve 70, preferably positioned proximate piston sleeve 40, for preventing reverse liquid flow from cavity 60 to reservoir 34. In addition, bladder inlet 44 includes a one way valve 72 for preventing liquid discharged from bladder 42 from entering collar member 68, i.e. to direct discharging liquid into the bladder outlet 46 for discharge through discharge end 28.

The toy water pistol 10 is activated by depressing the trigger 30 which, in a preferred embodiment, is pivotally connected to the elongated member portion 18 by the trigger fastener 31, such as a screw. Trigger 30 interfaces with bladder outlet 46 via an actuating member 80 which regulates the flow of discharged liquid exiting the discharge end 28. Actuator 80, which is preferably an elongated member, has a trigger end 84 disposed in contact with trigger 30, and a flow regulator end 82. Actuator 80 is pivotally connected to elongated member portion 18 via a pin which forms a pivot point 88 about which actuator 80 rotates. A bias spring 86 has one end in contact with a wall of elongated member portion 18, and another end in contact with the trigger end 84 of actuator 80. Bias spring 86 is positioned to normally bias trigger end 84 in a position against trigger 30, thereby positioning flow regulator end 82 against bladder outlet 46 for closing off the bladder outlet 46. When bladder outlet 46 is closed, the discharge of liquid from bladder chamber 42 is prevented.

Figure 4:
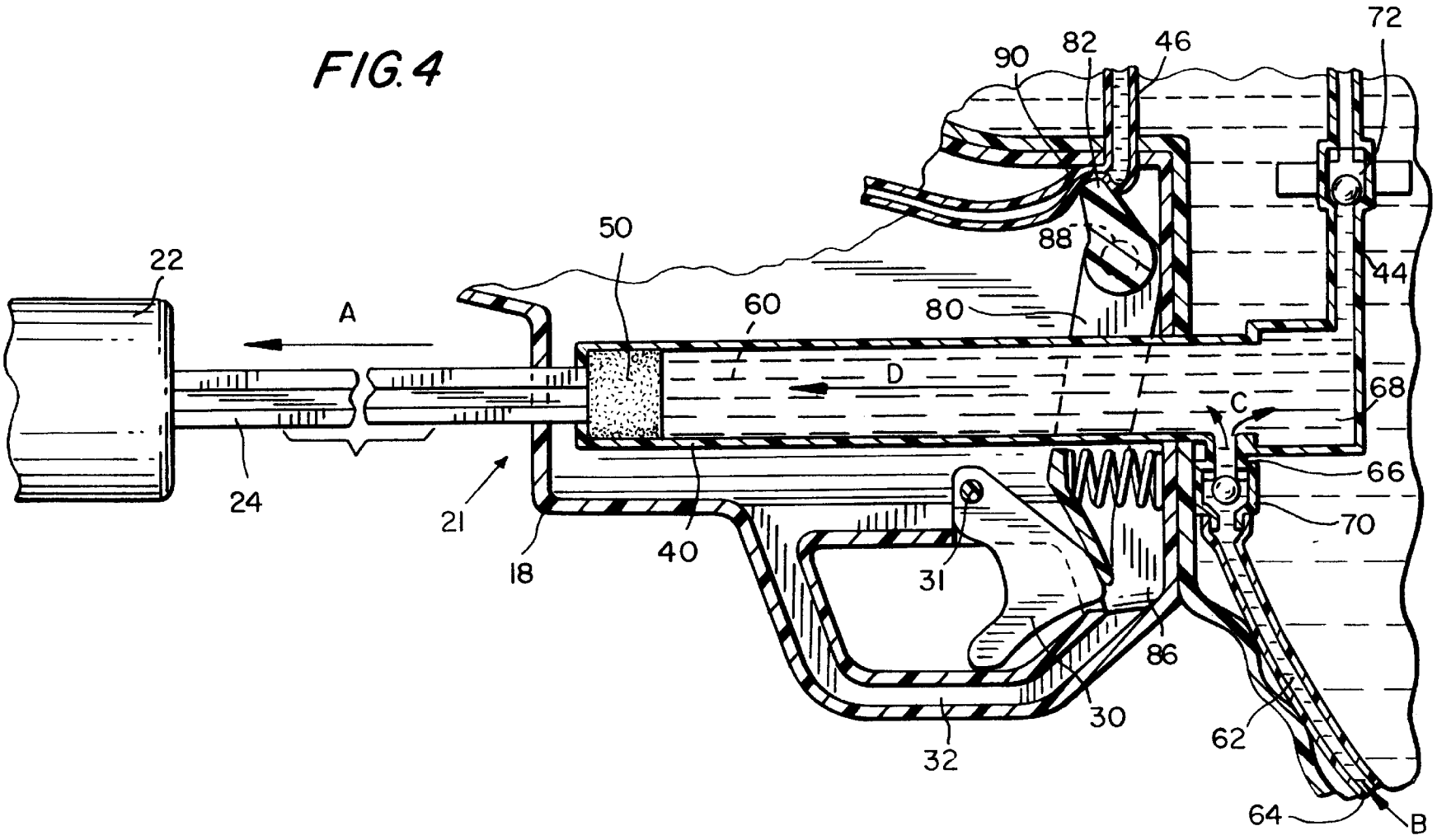
FIG. 4 is a partial cross-sectional view of the water gun of FIG. 2 showing one stage of a liquid loading function.
Figure 5:
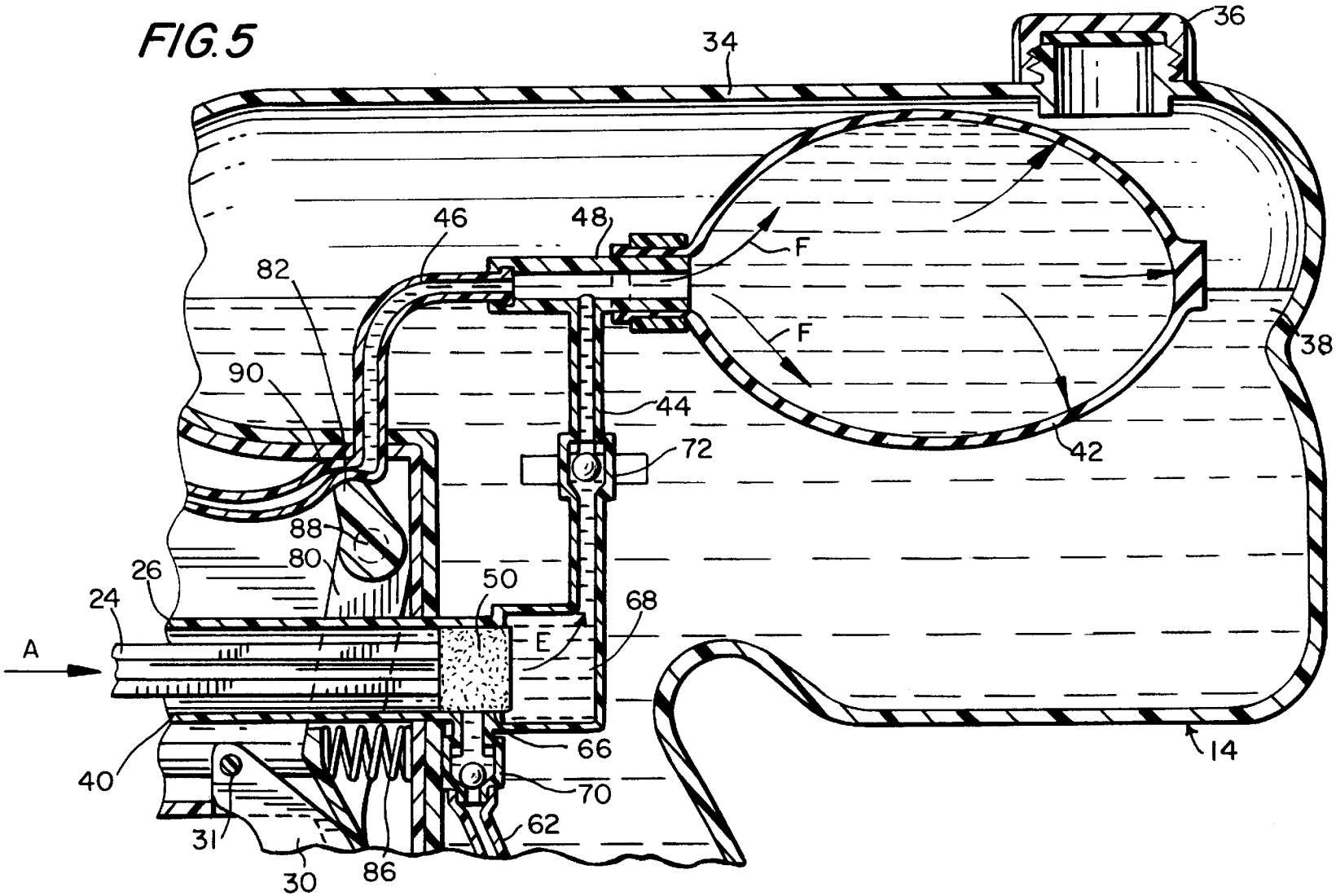
FIG. 5 is a partial cross-sectional view of the water gun of FIG. 1 showing another stage of the liquid loading function.
Figure 6:
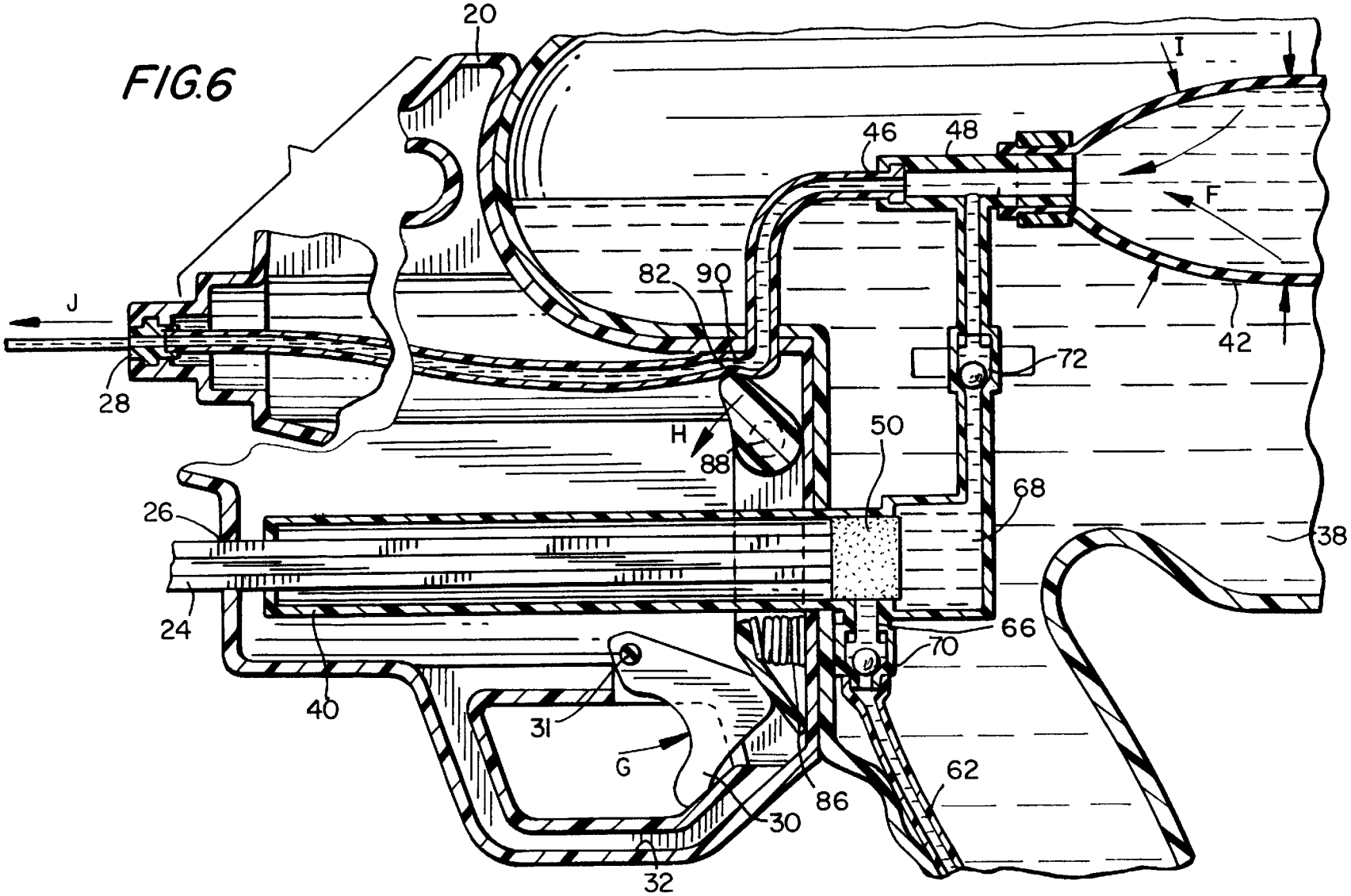
FIG. 6 is a cross-sectional view of the water gun of FIG. 1 showing the liquid discharge function.

Having now described the structure of a preferred embodiment of the present invention, the operation of the illustrated water gun 10 will now be described with particular reference to FIGS. 4 to 6. Prior to discharging liquid from the water gun 10, a charge of liquid must be provided to bladder 42. This is accomplished, with reference to FIG. 4, by drawing piston rod 22 outward away from elongated member portion 18 in a direction indicated by arrow A. This action causes plunger 50 to be displaced in the direction of arrow A within piston sleeve 40 which, in turn, develops a negative pressure in piston sleeve 40. As plunger 50 is moved in the direction of arrow A, liquid from the reservoir tank 34 is drawn by this negative pressure into loading inlet 62 in the direction of arrow B via inlet end 64. The direction of liquid flow is shown by arrows C and D. As liquid is thus drawn into loading cavity 60, loading inlet valve 70 and bladder inlet valve 72 are in appropriate positions to allow liquid to flow into the loading cavity.

Once liquid is drawn into loading cavity 60 as explained above, piston rod 22 is moved in the opposite direction to force the liquid from loading cavity 60 into collar 68. When so moved, valve 70 becomes closed to prevent reverse liquid flow into loading inlet 62 so that substantially all of the liquid in the loading cavity 60 will be transferred to collar 68. In addition, bladder inlet valve 72 is moved to an open position by the force applied by plunger 50 to the liquid so that the liquid in loading cavity 60 moves in the direction of arrow E into bladder inlet 44, through bladder support 48 and into bladder chamber 42.

Bladder chamber 42 is constructed of an inflatable or elastic type of material, such as a rubber balloon or the like, which applies pressure to liquid contained therein from the expanding force of the bladder. In the preferred embodiment, bladder 42 is dimensioned or shaped as an elongated tube when in a deflated state and the mouth or opening of the blabber is dimensioned for securely mating with the bladder support 48. Upon entry of the pressurized liquid (shown entering chamber 42 in the direction of arrows F), bladder chamber 42 expands to an inflated state. Upon termination of displacement of piston rod 22 in the direction A in FIG. 5, thereby ceasing the flow of liquid in the direction of arrow E, valve 72 moves under pressure to its closed position, thereby maintaining the liquid now contained in bladder chamber 42 in a pressurized state.

Once pressurized liquid is contained in bladder chamber 42, water gun 10 is "charged" or "active" and can be discharged by selective activation of the trigger 30. This is performed by squeezing of the trigger 30 in a direction shown by arrow G which causes trigger end 84 of actuator 80 to compress bias spring 86 and pivot or rotate flow regulator end 82 about pivot point 88 in the direction of arrow H, thereby moving flow regulator end 82 away from bladder outlet 46. Once flow regulator end 82 is released or brought out of contact with bladder outlet 46, the pressurized liquid in chamber 42 is released through bladder outlet 46 and through discharge end 28 in the direction of arrow J. As the liquid is released, and while trigger 30 remains depressed, bladder 42 returns to its contracted or rest position by elastically contracting inward as indicated by the arrows I. Of course, if trigger 30 is selectively depressed and released at intervals, liquid will emerge from discharge end 28 in like intervals. However, if trigger 30 remains depressed for a sufficient length of time, the substantially all of the liquid in bladder 42 will be expelled and another charge of liquid must then be supplied to bladder 42 by operating charge mechanism 21 in the manner described above before the water gun is again in a state of charge. Once reservoir tank 34 is depleted of liquid 38, additional liquid can be supplied thereto by first removing filling cap 36.

In a preferred embodiment, support 14 is constructed in two sections, with handle portion 16 comprising the reservoir tank 34. Also in the preferred embodiment, the various housing components of the toy water pistol 10 are constructed of a durable and light weight material such, for example, as ABS or high impact plastic, with the reservoir optionally being formed of a transparent or translucent material so as to allow for ready viewing of the level of liquid contained therein. The bladder chamber 42 is preferably constructed of natural rubber or surgical tubing. In addition, the preferred embodiment also includes a contoured grip 94 formed in the handle portion 16 for facilitating user grasping of the water gun 10, as is known in the art.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is the intention, therefore, to be limited only as indicated by the scope of the claims appended hereto.

I claim:

1. A toy water pistol for discharging an amount of liquid maintained in a pressurized state, comprising:

a reservoir for containing liquid;

an expandable bladder disposed in said reservoir for holding an amount of liquid under pressure;

conduit means for providing liquid from said reservoir to said bladder in a pressurized state;

charging means in communication with said conduit means and moveable between a first position and a second position for drawing liquid from said reservoir into said conduit means under pressure when said charging means is moved from a first position to a second position, and for expelling the pressurized liquid from said conduit means into said bladder when said charging means is moved from said second position to said first position;

an output conduit connected to said bladder for discharging pressurized liquid from said bladder; and selectively activatable trigger means engageable with said output conduit for controlling the discharge of liquid from said bladder, said trigger means including a member moveable in and out of engagement with said output conduit from a first position wherein said member presses against said output conduit to restrict the flow of liquid from said output conduit, and from a second position wherein said member is brought out of contact with said output conduit to permit the flow of liquid from said bladder through said output conduit.

2. The toy water pistol of claim 1, further comprising a barrel having a discharge end in communication with said output conduit for discharging liquid from said bladder.

3. The toy water pistol of claim 1, further comprising output conduit valve means connected to said output conduit for preventing liquid flow from said bladder to said output conduit when said trigger means is activated.

4. The toy water pistol of claim 1, wherein said reservoir includes a filling inlet through which liquid is supplied to said reservoir.

5. The toy water pistol of claim 1, further comprising a handle portion, said handle portion defining a grip for facilitating user grasping of said handle portion.

6. The toy water pistol of claim 1, wherein said member in said trigger means forms a pinch point against said output conduit when said member is in said first position.

7. The toy water pistol of claim 1, wherein said conduit means comprises a member defining a charge cavity therein, said charge cavity receiving liquid from said reservoir when said charging means is moved to said first position, and discharging liquid to said bladder when said charging means is moved to said second position.

8. The toy water pistol of claim 7, wherein said charging means comprises a piston slidably engageable with said charge cavity and moveable between said first and second positions.

9. The toy water pistol of claim 7, wherein said member in said trigger means forms a pinch point against said output conduit when said member is in said first position.

10. The toy water pistol of claim 7, further comprising inlet conduit valve means connected to said inlet conduit for preventing liquid flow from said charge cavity to said inlet conduit when said charging means is moved from said second position to said first position.

11. The toy water pistol of claim 10, further comprising output conduit valve means connected to said output conduit for preventing liquid flow from said bladder to said output conduit when said trigger means is activated.

12. The toy water pistol of claim 4, wherein said reservoir includes a filling inlet through which liquid is supplied to said reservoir.

13. The toy water pistol of claim 12, further comprising a handle portion, said handle portion defining a grip for facilitating user grasping of said handle portion.

14. The toy water pistol of claim 12, wherein said reservoir is constructed of a substantially transparent material.

* * * * *